US005207333A

United States Patent [19]

Peng

[11] Patent Number: 5,207,333

[45] Date of Patent: May 4, 1993

[54] MULTI-STORIED PARKING/DISPLAYING RACK

[76] Inventor: Luke S. Peng, 7F, No. 32, hsin-yi Rd., Sec. 6, Taipei, Taiwan

[21] Appl. No.: 553,312

[22] Filed: Jul. 17, 1990

[51] Int. Cl.[5] ..... A47F 7/00

[52] U.S. Cl. ..... 211/13; 414/495; 414/288; 187/8.71; 254/122; 254/9 C; 211/85

[58] Field of Search ..... 211/85, 13, 130; 108/145; 248/129, 132, 421, 164; 414/495, 227, 228; 187/18, 8.71; 254/122, 9 C

[56] References Cited

U.S. PATENT DOCUMENTS

| | | | |
|---|---|---|---|
| 241,416 | 5/1881 | Porter | 254/122 |
| 988,927 | 4/1911 | Canham | 248/421 |
| 1,203,545 | 10/1916 | Moore | 248/421 |
| 1,769,140 | 7/1930 | Kaufman | 248/421 |
| 2,043,887 | 6/1936 | Dement | 254/9 C |
| 3,003,746 | 10/1961 | Gridley | 187/18 |
| 3,387,722 | 6/1968 | Fisher, Sr. et al. | 187/8.71 |
| 4,221,420 | 9/1980 | Vencill et al. | 254/122 X |
| 4,373,701 | 2/1983 | Kishi | 254/9 C X |
| 4,457,403 | 7/1984 | Ream | 187/18 |
| 4,901,980 | 2/1990 | Hansen | 254/9 C |
| 5,044,866 | 9/1991 | Harp | 414/495 |

FOREIGN PATENT DOCUMENTS

| | | | |
|---|---|---|---|
| 1094963 | 2/1955 | Fed. Rep. of Germany | 414/227 |

*Primary Examiner*—Carl D. Friedman
*Assistant Examiner*—Korie H. Chan
*Attorney, Agent, or Firm*—Longacre & White

[57] ABSTRACT

A simplified, convenient and compact multi-storied parking and/or displaying rack being collapsible and movable is provided. The rack includes at least two vertically spaced parking/displaying members each of which includes a first end, two opposite sides and a second end, at least a vertically moving mechanism mounted between the two members for moving them apart from or toward each other, and at least a positioning mechanism mounted on the moving mechanism and capable of holding the two members in a vertically spaced relationship.

8 Claims, 10 Drawing Sheets

MULTI-STORIED PARKING/DISPLAYING RACK

BACKGROUND OF THE INVENTION

The present invention relates to a rack, and more particularly to a parking/displaying rack.

A multi-storied parking rack according to the prior art, as shown in FIG. 1, comprises side walls 1, vertically spaced plates 2, a top plate 3 and an elevator 4 for elevating a car or the like to a height at which one of plates 2 resides. Such a parking rack is difficult to move and is provided with elevator 4 so that it is inconvenient and space-occupying.

It is therefore attempted by the Applicant to deal with the above situation encountered by the prior art.

SUMMARY OF THE INVENTION

It is therefore an object of the present invention to provide a multi-storied parking/displaying rack being convenient and compact.

It is further an object of the present invention to provide a multi-storied parking/displaying rack being collapsible and movable.

According to the present invention, a collapsible multi-storied parking/displaying rack includes at least two vertically spaced parking/displaying members, at least a vertically moving mechanism mounted between the two parking/displaying members for moving the two members apart from or toward each other in parallel, and at least a positioning mechanism mounted on the moving mechanism and capable of holding the two members in a vertically spaced relationship.

The present invention may best be understood through the following description with reference to the accompanying drawings, in which:

DETAILED DESCRIPTION OF THE PREFERRED EMBODIMENTS

Figure 1:
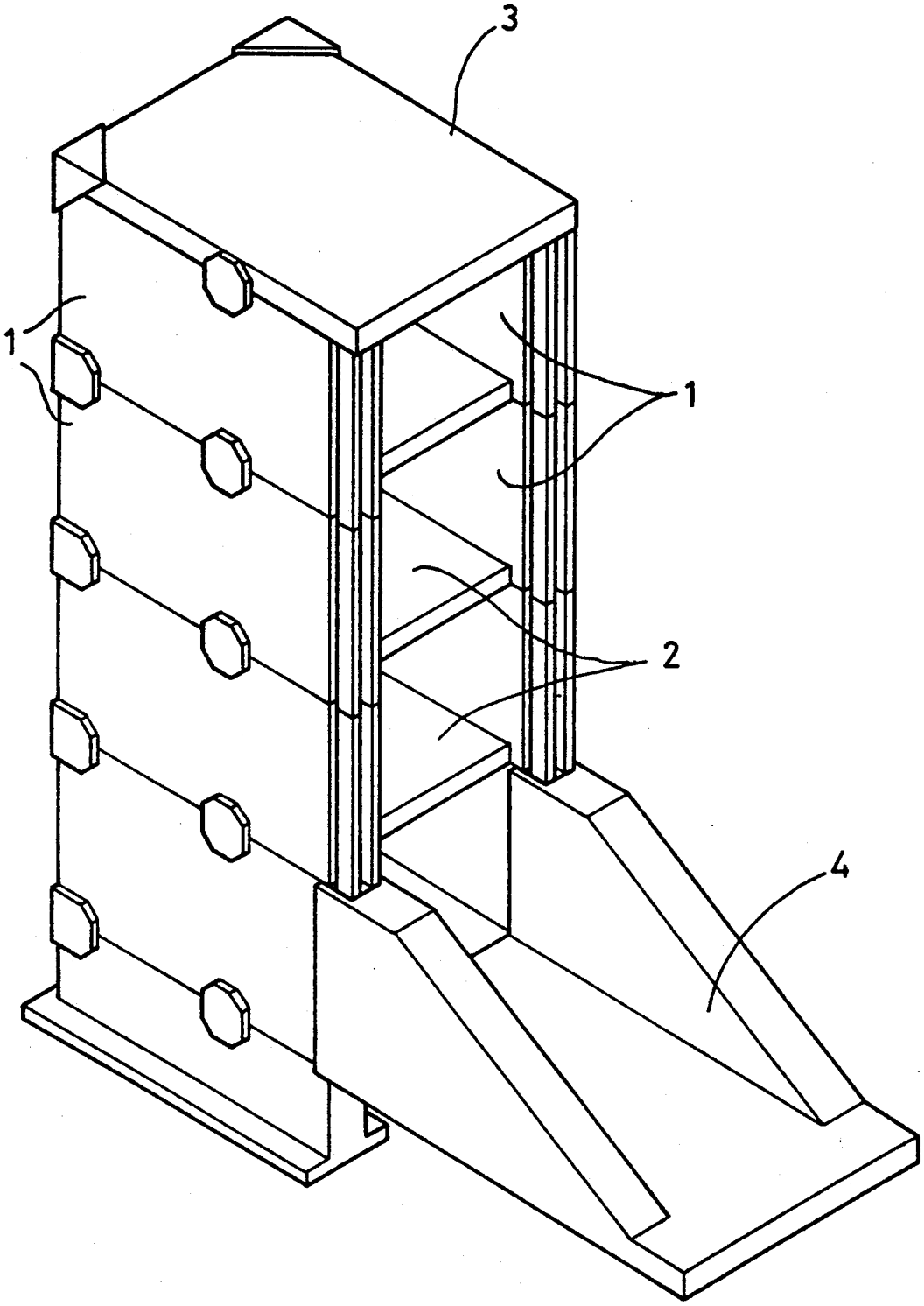
FIG. 1 (PRIOR ART)
FIG. 1 is a perspective view showing a multi-storied parking rack according to the prior art.
Figure 2:
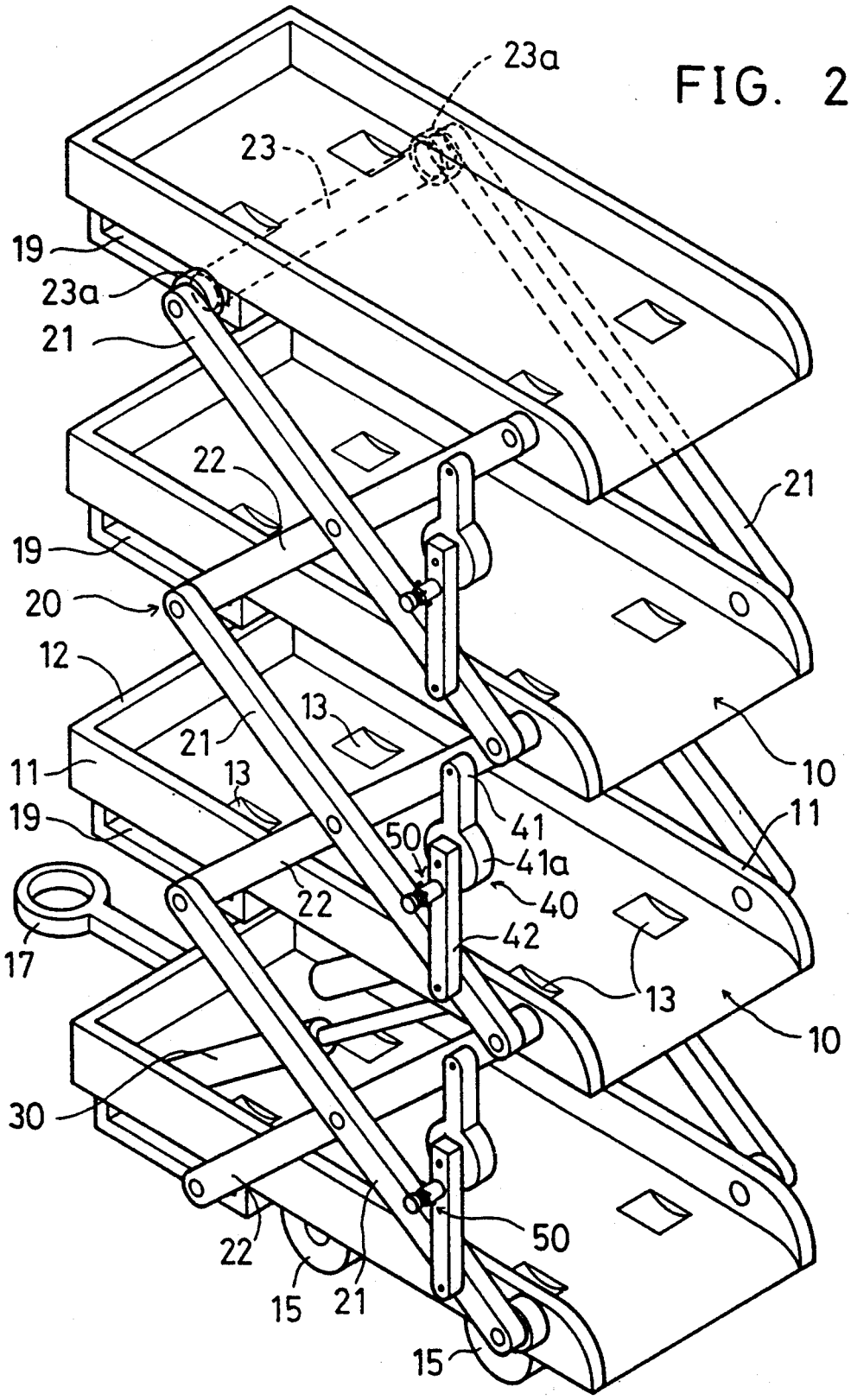
FIG. 2 is a perspective view showing a preferred embodiment of a multi-storied parking/displaying rack according to the present invention.
Figure 4:
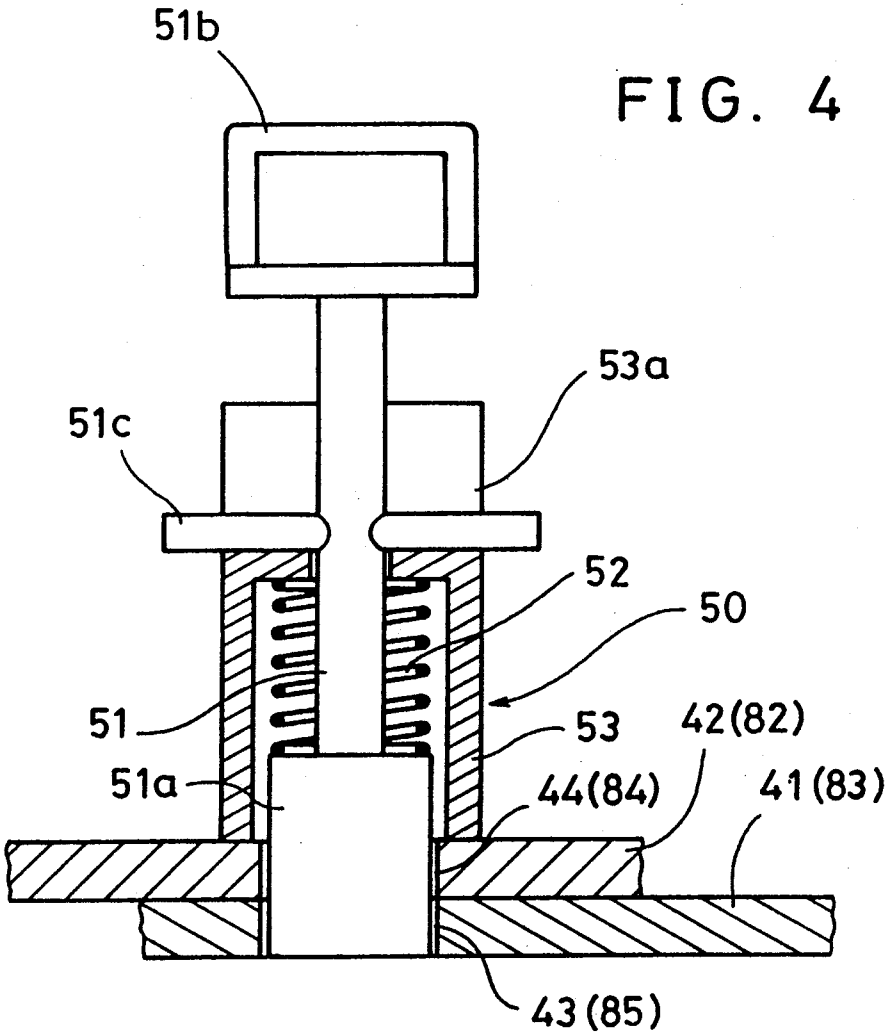
FIG. 4 is a sectional view of a positioning mechanism in FIG. 3.
Figure 3:
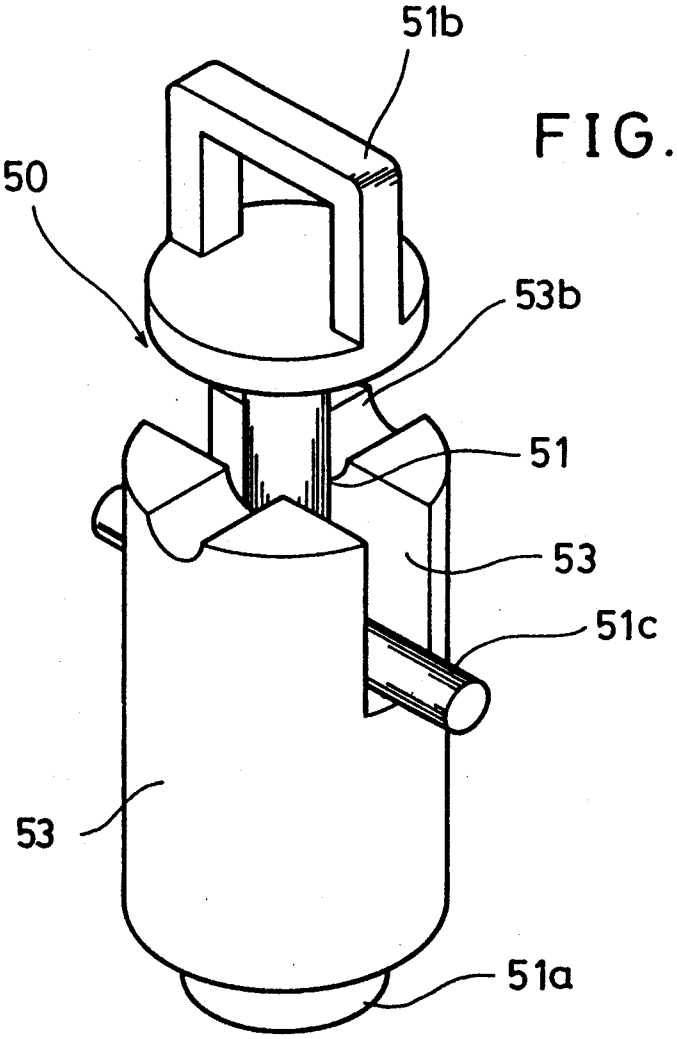
FIG. 3 is a perspective view showing a positioning mechanism for a multi-storied parking/displaying rack in FIG. 2.

Referring now to FIGS. 2–4, a multi-storied parking/displaying rack according to the present invention includes 4 vertically spaced parking/displaying members 10, 3 vertically moving mechanisms 20 each of which is mounted between two adjacent members 10 for moving the two members 10 apart from or toward each other in parallel by means of the operation of a pair of oil cylinders 30, and 3 positioning mechanisms 40 respectively mounted on moving mechanisms 20 for assistantly maintaining members 10 in a vertically spaced relationship. Each parking/displaying member 10 being an elongate plate attaches thereto or includes two vertical side flanges 11, a first end flange 12 which can be obviated so that a car or the like can freely pass through either end of member 10, a second opposite open end, indentations 13 for respectively partly receiving therein wheels of a car or the like, and a bottom end guiding groove 19. The lowest member 10 collapsibly mounts thereunder wheels 15 so that when wheels 15 are in operation the present rack can easily be moved, and further includes an engaging medium 17 by which the present rack can be pulled to move.

The pair of cylinders 30 are symmetrically provided between the most lower two adjacent members 10 near two opposite side flanges 11 thereof. Each moving mechanism 20 includes a pair of first linking pieces 21 respectively disposed on two sides of relevant members 10 and each of which includes a first end disposed near end flange 12 of an upper member 10 and a second end pivotally fixed to a lower member 10 near the second open end thereof, a pair of second linking pieces 22 respectively crossly pivotally fixed to first pieces 21 end each of which includes a first end disposed near end flange 12 of lower member 10 and a second end pivotally fixed to upper member 10 near the second open end thereof, and a connecting rod 23 which connects together the first ends of first linking pieces 21, has two ends thereof rotatably mounted in two bearings **23*a* respectively fixed to the first ends of first pieces 21 and is capable of sliding in guiding groove 19. The first ends of second linking pieces 22 of an upper moving mechanism 20 are respectively pivotally connected to the first ends of first linking pieces 21 of a most adjacent lower moving mechanism 20 and pivotally fixed to two ends of another connecting rod 23. The second ends of first linking pieces 21 of an upper moving mechanism 20 are respectively pivotally connected to the second ends of second linking pieces 22 of a most adjacent lower moving mechanism 20 and pivotally fixed to two side flanges 11 of a corresponding member 10 so that 3 moving mechanisms 20 are mechanically interrelated in a manner that is one moving mechanism 20 is in operation, the other two moving mechanisms 20 will also be in operation which enables the present rack to possess only an oil cylinder 30 or a pair of oil cylinders 30 and only a positioning mechanism 40**.

Each positioning mechanism 40 includes a first piece 41 having a first end pivotally fixed to a second linking piece 22 of a moving mechanism 20 and a second disk end **41*a* having a positioning hole (44), a second piece 42 having a first end pivotally fixed to a first linking piece 22 of the moving mechanism 20**, and intermediate positioning hole (44) and a second end pivotally connected to disk end 41*a*, and a positioning pin device 50 inserted into the positioning holes of pieces 41 and 42. Positioning pin device 50 includes a hollow cylindrical housing 53 having an open bottom end and a top end having and axial groove 53*a* and a diametral indentation 53*b* inclined with respect to groove 53*a*, a compression spring 52 received in housing 53, and a positioning pin 51 which includes an enlarged end 51*a* urged by spring 52 to protrude into positioning holes of pieces 41 and 42, an intermediate portion perpendicularly fixing thereto a positioning rod 51*c* capable of being seated in groove 53*a* to allow spring 52 to protrude enlarged end 51*a* into positioning holes of pieces 41 and 42, and an end pulling handle 51*b* for upwardly pulling positioning pin 51 to rest positioning rod 51*c* in indentation 53*b* to disengage enlarged end 51*a* from positioning holes of pieces 41 and 42 so that positioning mechanism 40 can be collapsed when the piston rod of oil cylinder 30 retracts. When the piston rod of oil cylinder 30 fully extends, positioning holes of pieces 41 and 42 will get aligned so that spring 52 can urge enlarged end 51*a* to protrude into the positioning holes.

Figure 10:
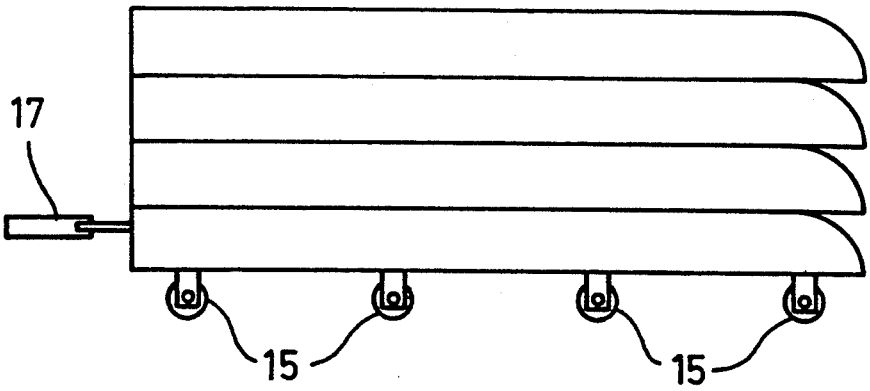
FIG. 10 is a side view showing a collapsed multi-storied parking/displaying rack in FIG. 2, 5, 6 or 12.

The operation of the present invention is as follows:

A multi-storied parking/displaying rack according to the present invention in a collapsed state, as shown in FIG. 10, is moved to the desired location at which the present rack can stably be positioned after wheels 15 are collapsed. Then, positioning rod 51*c* is put in groove 53*a* and oil cylinder 30 operates to vertically separate apart members 10 until enlarged end 51*a* protrudes into the positioning hole of disk end 41*a*. Thereafter oil cylinder 30 can be deenergized. If the present rack is to be collapsed or moved to another location, positioning rod 51*c* is first put in indentation 53*b* so that the present rack will automatically collapse owing to the weight thereof. Then, wheels 15 are set to contact the ground surface for enabling the present rack to be moved.

Figure 5:
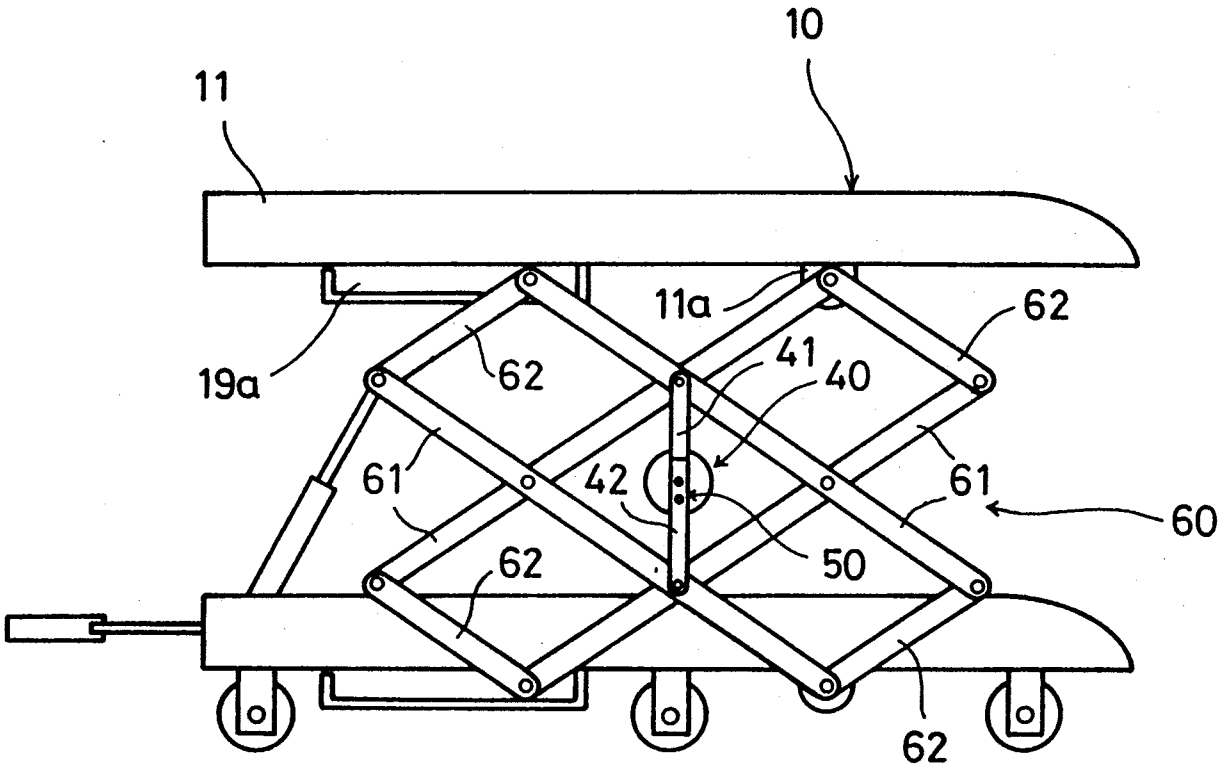
FIG. 5 is a side view showing a second preferred embodiment of a multi-storied parking/displaying rack according to the present invention.

As shown in FIG. 5, a second preferred embodiment of a multi-storied parking/displaying rack according to the present invention is the same to that shown in FIG. 2 except the vertically moving mechanism 60 which will be described hereinafter. Moving mechanism 60 includes at either side of members 10 a first pair of spaced primary links 61, a first pair of spaced secondary links 62 being ⅓ of links 61 in length and pivotally connected to links 61 to form a first parallelogram which includes a first corner disposed near the first end of an upper member 10 and a diagonal corner pivotally fixed to a lower member 10 near the second end thereof, a second pair of spaced primary links 61, a second pair of spaced secondary links 62 being ⅓ of second links 61 in length and pivotally connected to second links 61 to form a second parallelogram which is pivotally connected to the first parallelogram to totally form 5 rhombuses and includes a first corner disposed near the first end of the lower member 10 and a diagonal corner pivotally fixed to a bottom flange 11*a* of the upper member 10 near the second end thereof, an oil cylinder, and a connecting rod pivotally connecting together first corners of second parallelograms of moving mechanism 60 and slidably guided in guiding groove 19*a* of the lowest member 10. Another connecting rod pivotally connects together first corners of first parallelograms of a lower moving mechanism 60 and first corners of second parallelograms of a most adjacent upper moving mechanism 50. Positioning mechanism 40 is mounted between the first and second parallelograms of moving mechanism 60 in a manner that when two adjacent members 10 are separated apart from each other, pieces 41 and 42 are vertically straight. The operation of this embodiment also having a collapsed state as shown in FIG. 10 is the same with that of the first embodiment.

Figure 6:
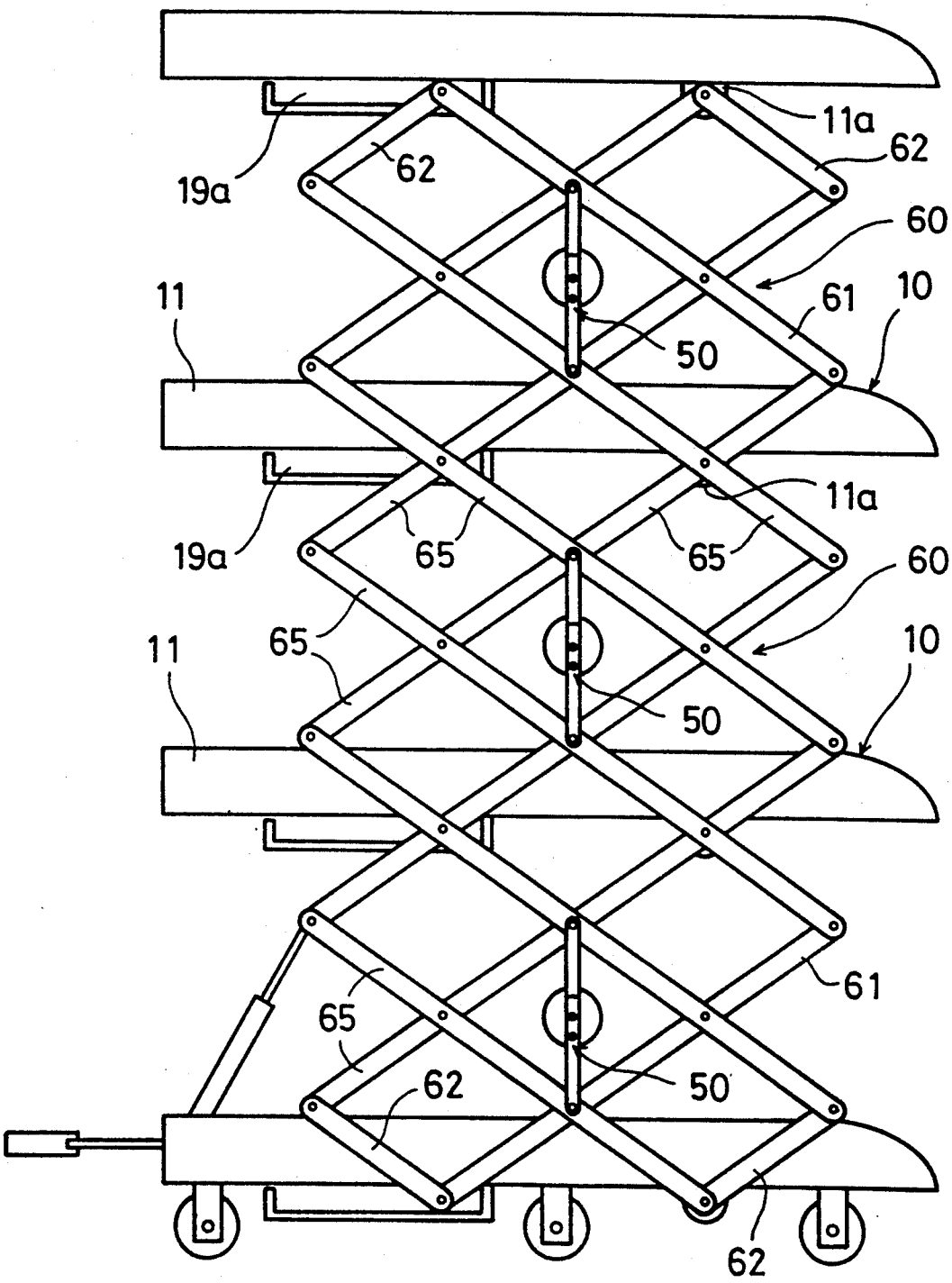
FIG. 6 is a side view showing a third preferred embodiment of a multi-storied parking/displaying rack according to the present invention.

As shown in FIG. 6, a third preferred embodiment of a multi-storied parking/displaying rack according to the present invention is similar to that shown in FIG. 5 with the exception that 3 moving mechanisms 60 therein are connected in a manner that one of first links 62 of an upper moving mechanism 60 can be integrally formed to a corresponding one of second links 61 of a most adjacent lower moving mechanism 60 and one of first links 62 of the lower moving mechanism 60 can be integrally formed to a corresponding one of second links 61 of the upper mechanism 60 to respectively totally form 8 long links 65 so that when one mechanism 60 is in operation, the other two mechanisms 60 will also be set in operation and thus only one oil cylinder is required for this embodiment.

Figure 7:
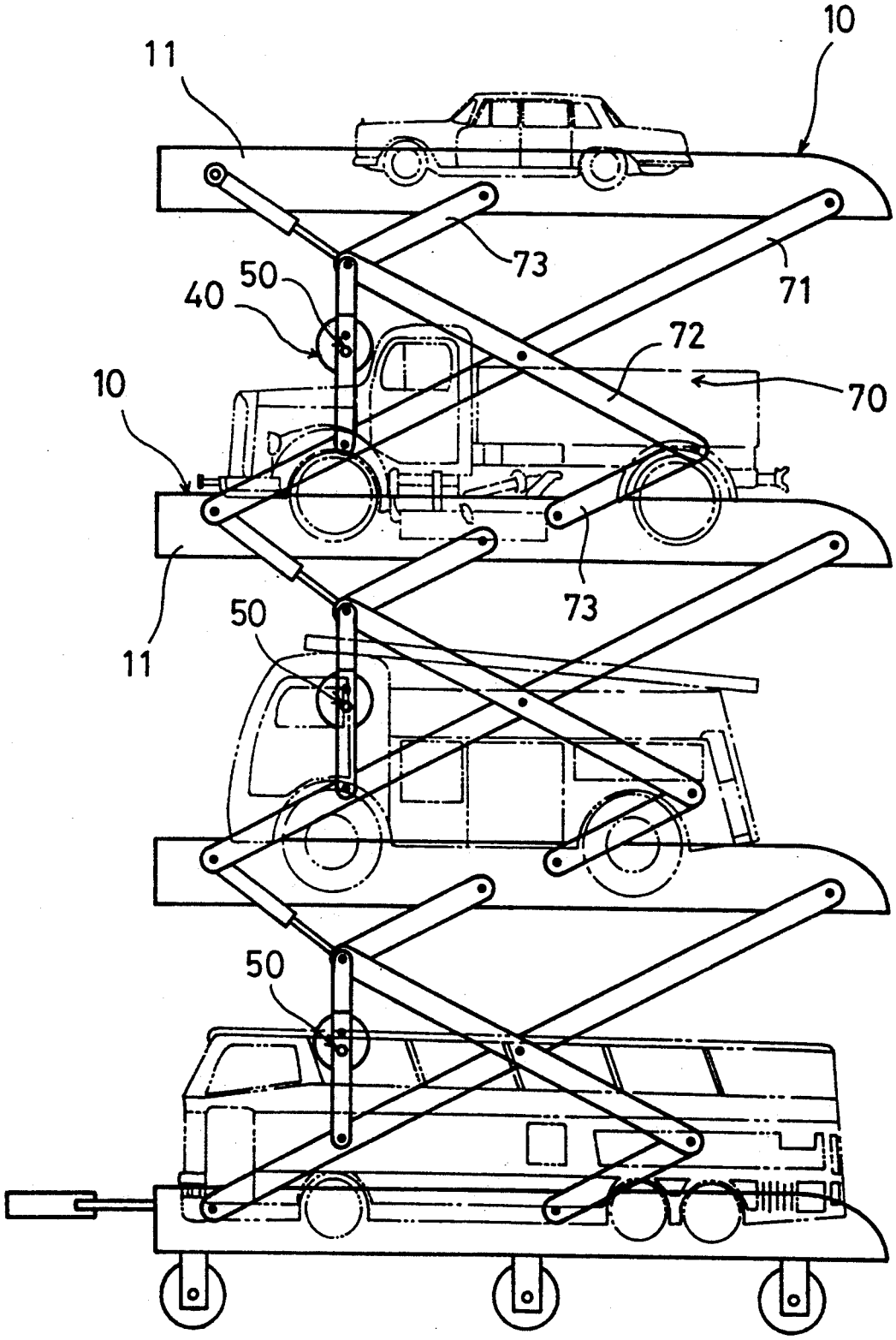
FIG. 7 is a side view showing a fourth preferred embodiment of a multi-storied parking/displaying rack according to the present invention.
Figure 9:
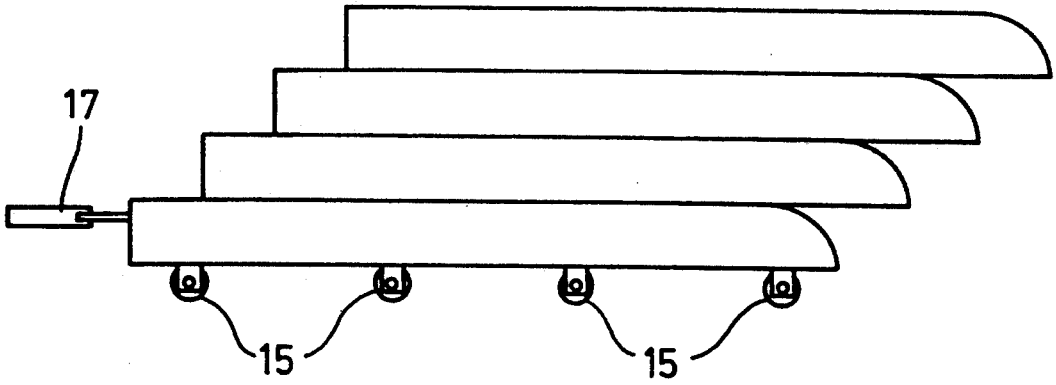
FIG. 9 is a side view showing a collapsed multi-storied parking/displaying rack in FIG. 7 or 8.

As shown in FIG. 7, a fourth preferred embodiment of a multi-storied parking/displaying rack according to the present invention is the same with that shown in FIG. 2 except the vertically moving mechanism 70 and the arrangement of the oil cylinder which will both be described hereinafter. Moving mechanism 70 includes at either side of members 10 a primary link 71 having a first end pivotally connected to a side flange 11 of and upper member 10 near the second end thereof and a second end pivotally fixed to a side flange 11 of a most adjacent lower member 10 near the first end thereof, a first link 72 bisectedly bisecting and pivotally connected to primary link 71 and having two opposite ends, and two second links 73 respectively pivotally mounted at the two opposite ends of first link 72 and the relevant two members 10 in a manner that a distance of pivoting points of primary link 71 and one of second links 73 on the upper member 10 is equal to that of the primary link 71 and the other second link 73 on the lower member 10. Each moving mechanism 70 is accompanied by an oil cylinder since mechanisms 70 are mutually independent. Positioning mechanism 40 is mounted between primary link 71 and first link 72. The operation of this embodiment having a collapsed state as shown in FIG. 9 is identical to that of the first embodiment.

Figure 11:
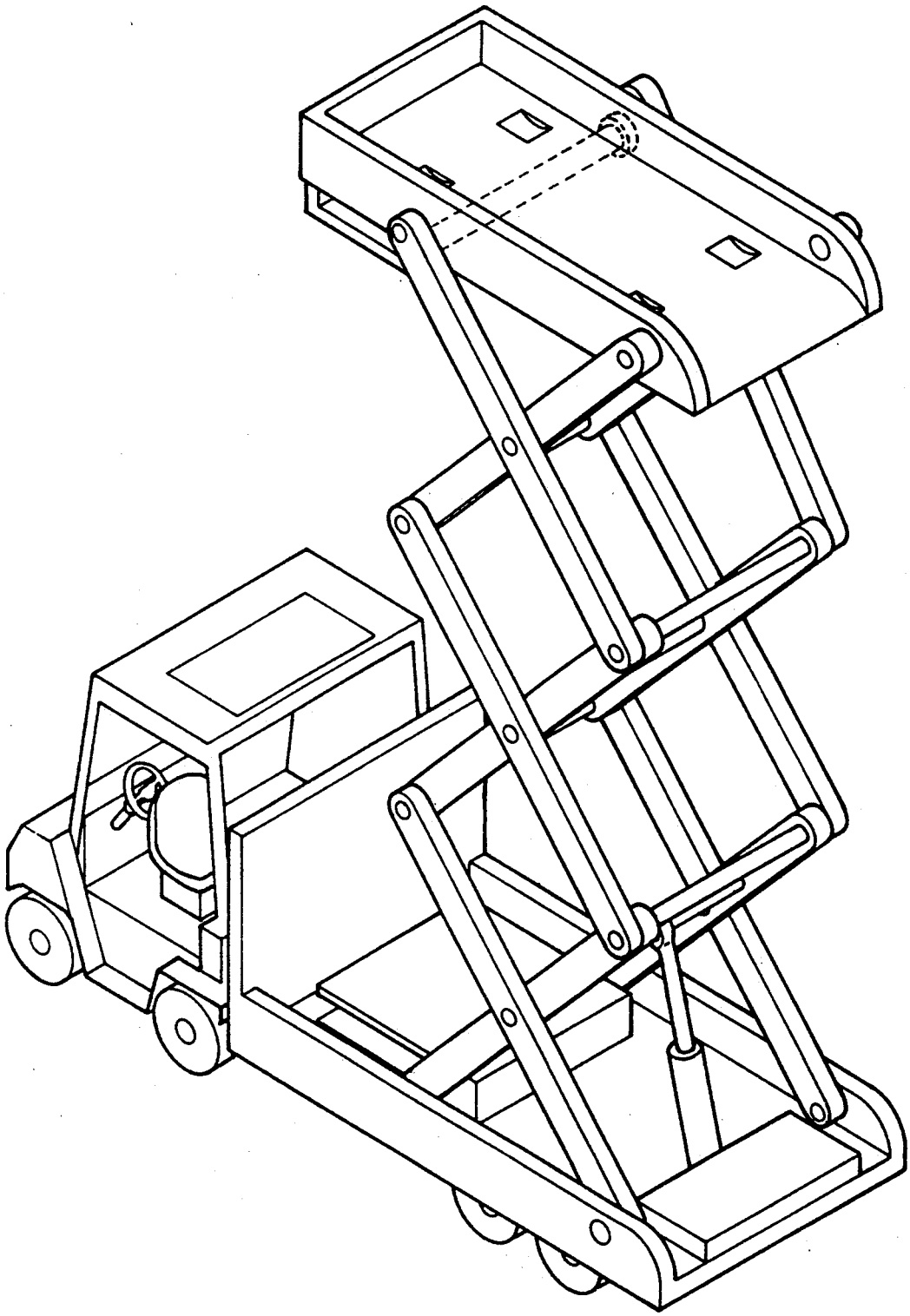
FIG. 11 is a schematic view showing an elevating truck for a multi-storied parking/displaying rack according to the present invention.

FIG. 11 shows an elevating truck for elevating a car or the like to a height at which the member 10 on which the car or the like is to be parked/displayed resides.

Figure 8:
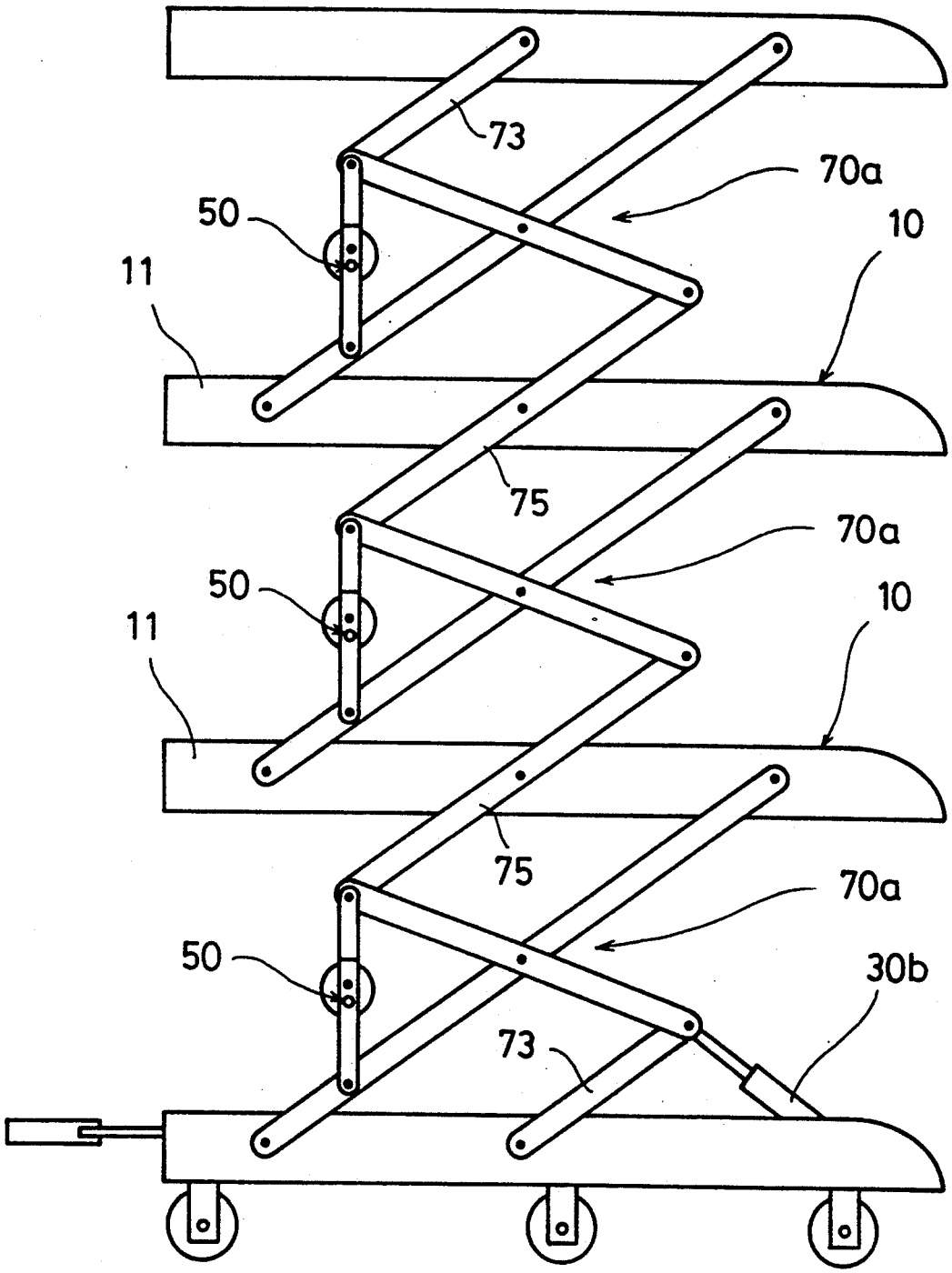
FIG. 8 is a side view showing a fifth preferred embodiment of a multi-storied parking/displaying rack according to the present invention.

As shown in FIG. 8, a fifth embodiment of a multi-storied parking/displaying rack according to the present invention is identical to the fourth embodiment except that the moving mechanisms 70*a* therein are connected in a manner that one of second links 73 of an upper mechanism 70*a* can be integrally formed to a corresponding one of second links 73 of a most adjacent lower mechanism 70*a* to form a long link 75 if the second links 73 are both pivotally fixed to the same member 10 so that only one oil cylinder 30*b* is required for the present rack.

Figure 12:
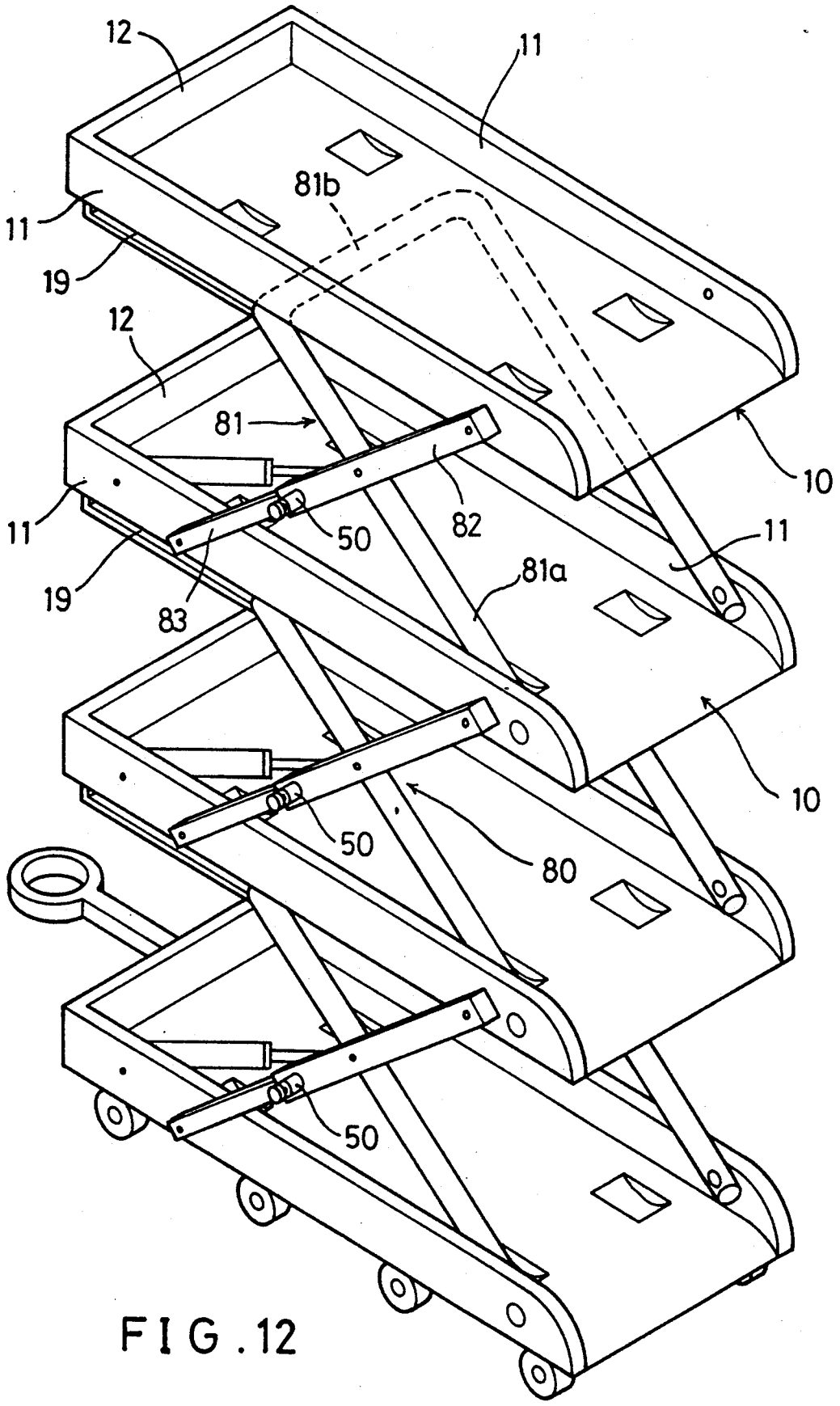
FIG. 12 is a perspective view showing a sixth preferred embodiment of a multi-storied parking/displaying rack according to the present invention.

As shown in FIG. 12, a sixth preferred embodiment of a multi-storied parking/displaying rack according to the present invention is identical to the first embodiment except the moving mechanisms 80 and the arrangement of the oil cylinder which will be described hereinafter. Moving mechanism 80 includes a U-shaped piece 81 having two side arms 81*a* respectively pivotally connected to side flanges 11 of a lower member 10 near the second end thereof and a bridging piece 81*b* slidably guided in groove 19 of an upper member 10, a hollow guiding piece 82 having a first open end, a second end pivotally fixed to a side flange 11 of the upper member 10 near the second end thereof and an intermediate portion pivotally fixed to one of side arms 81*a*, and a sliding piece 83 having a first end pivotally fixed to a side flange 11 of lower member 10 near the first end thereof and a second free end inserted into guiding piece 82. Each mechanism 80 is accompanied by and oil cylinder since mechanisms 80 are not interrelated. Positioning mechanism 50 is mounted on guiding piece 82 having a positioning hole 84 capable of aligning with a positioning hole 85 provided on sliding piece 83 when two relevant members 10 are separated apart from each other for operation so that positioning pin 51 can protrude into the positioning holes of guiding and sliding pieces 82 and 83 for maintaining the two members 10 in a vertically spaced relationship.

The above described embodiments are illustrative but not limitative and can easily be modified and varied by those skilled in the art without departing from the spirit and scope of the present invention which is defined in the appended claims.

What I claim is:

1. A collapsible multi-storied parking and/or displaying rack comprising:

at least two vertically spaced parking/displaying members each of which includes a first end, two opposite sides and a second end;

at least one vertically moving mechanism mounted between said two parking/displaying members for moving in parallel said two members apart from or toward each other; and at least one positioning mechanism mounted on said moving mechanism and capable of maintaining said two members in a vertically spaced relationship, said positioning mechanism including a first piece having a first end pivotally fixed to a first point of said moving mechanism and a second end having a positioning hole, a second piece connected to said first piece having a first end pivotally fixed to a second point of said moving mechanism, an intermediate positioning hole on said second piece capable of being aligned with said positioning hole of said first piece, and a second end of said second piece being pivotally connected to said second end of said first piece; and a positioning pin device capable of being inserted into said positioning holes of said first and second pieces;

wherein said moving mechanism includes:

an oil cylinder enabling said two members to be moved apart from or toward each other, a pair of first linking pieces respectively disposed on said two sides of said each member and each of which includes a first end pivotally and slidably attached to an upper one of said members near said first end of said upper member, and a second end pivotally fixed to a most adjacent lower one of said members near said second end of said adjacent lower member; and a pair of second linking pieces respectively disposed on said two sides of said each member and each of which includes a first end pivotally and slidably attached to said adjacent lower member near said first end of said lower member, and a second end pivotally fixed to said upper member near said second end of said upper member.

2. A rack according to claim 1 wherein wheels are collapsibly mounted under the lowest one of said members such that when said wheels are in operation, said rack can easily be moved.

3. A rack according to claim 1 wherein said first end and said two sides of said each member vertically attach thereto a surrounding flange.

4. A rack according to claim 1 wherein said each member includes thereon indentations for respectively partly receiving therein wheels of a car or the like.

5. A rack according to claim 1, further comprising an engaging medium by which said rack can be pulled to move.

6. A rack according to claim 1 wherein said moving mechanism includes an oil cylinder enabling said two members to be moved apart from or toward each other.

7. A rack according to claim 1, further comprising a connecting rod connecting together said first ends of said pair of first linking pieces and capable of sliding under said upper member near said first end of said upper member.

8. A rack according to claim 1 wherein said positioning pin device includes:

a hollow cylindrical housing having an open bottom end and a top end having an axial groove and a diametrical indentation inclined with respect to said axial groove;

a compression spring received in said housing;

an enlarged end capable of being urged by said spring to protrude into said positioning holes;

a positioning rod, perpendicularly fixed to an intermediate portion, capable of being seated in said groove to allow said spring to protrude said enlarged end into said positioning holes; and an end pulling handle capable of enabling said positioning rod to be seated in said indentation to disengage said enlarged end from said positioning holes.

* * * * *